US005618416A

United States Patent [19]

Haefner

[11] Patent Number: 5,618,416

[45] Date of Patent: Apr. 8, 1997

[54] ROOF DRAIN

[76] Inventor: William P. Haefner, McCullough Plumbing, Inc., 2436 Pennsylvania Ave., Madison, Wis. 53704

[21] Appl. No.: 454,594

[22] Filed: May 30, 1995

[51] Int. Cl.[6] ..... E04D 13/04; E03F 5/04

[52] U.S. Cl. ..... 210/163; 210/166; 285/42

[58] Field of Search ..... 210/161, 163, 210/232, 460, 166; 285/42, 338, 346; 405/121

[56] References Cited

U.S. PATENT DOCUMENTS 3,809,411 5/1974 Emberson .
3,884,809 5/1975 Logsdon .
3,909,412 9/1975 Patry .
4,243,251 1/1981 Lindquist .
4,487,690 12/1984 Logsdon .
4,505,499 3/1985 Uglow .
4,505,814 3/1985 Marshall .
5,141,633 8/1992 Walczak et al. ..... 210/163

*Primary Examiner*—Robert J. Popovics
*Attorney, Agent, or Firm*—Richard C. Litman

[57] ABSTRACT

A roof drain including a grated, inverted, frusto-conically-shaped cover received in a roofing material clamp having a radial, upstanding, debris-discouraging flange. The cover and roof material clamp are demountably fixed to a flanged drain body and clampingly maintain roof material therebetween. The drain body is received by a flanged sleeve. The drain body and sleeve flanges clampingly maintain roof substrate therebetween by means of a nut threadingly interengaged with threads on the drain body which urges the sleeve toward the roof substrate.

3 Claims, 2 Drawing Sheets

ROOF DRAIN

BACKGROUND OF THE INVENTION

1. Field of the Invention

This invention relates to roof drains. More specifically, the present invention is an adjustable mounting, straining drain which clampingly and sealingly mounts in an aperture of a roof and conveys fluid to an extant drain pipe.

2. Description of the Prior Art

Roofs shield buildings from inclement weather. Many roof configurations exist; some providing more shielding than others. Flat, horizontal roofs represent the more problematic roof configurations used in modern building construction. Time and gravity combine to form sags in a flat roof. Water and debris collect in the sags. Eventually, the roof weakens and leaks develop. Fluid and matter seep into and disintegrate the structure of the building. Sunlight and/or extreme temperatures may hasten the harsh effects the fluid and debris may cause.

Roof drains help rid roofs of trapped fluid and debris. However, roof drains must satisfy a multiplicity of design and architectural criteria. First, roof drains must be able to strain out larger debris. Deterring larger debris from entering the drain pipe decreases the likelihood of drain clogs. Second, roof drain-roof junctions must have a water-impervious seal. Fluid leaking into the roof drain aperture under the roofing material seeps into and disintegrates the structure of the building. Third, roof drains should not distort the natural plane of the roof surface. A roof drain that causes a bulge in the natural roof plane will create a ringed depression about the roof drain which may collect fluid and debris. A roof drain should maintain a snug fit to the roof. Fourth, a roof drain should be installable in a variety of applications. Manufacturing of one kind of roof drain having universal application will pass on to consumers large economies-of-scale cost savings.

Several types of roof drains are described in the literature. For example, U.S. Pat. No. 3,809,411, issued May 7, 1974, to John E. Emberson, describes a drain fitting. The drain fitting includes a hollow, cylindrical metal body having an upper and lower portion. The upper portion has a larger inside diameter than the lower portion. The upper portion of the body includes an outward annular flange that mounts flush to a roof or floor. The lower portion of the body includes an inward annular flange. A hollow cylindrical collar is received and is maintained within in the upper portion of the body. An O-ring seats between the collar and the lower annular flange. Hollow, cylindrical conduit having a smaller outside diameter than the inside diameter of the lower annular flange of the collar is received through the flange aperture. Pressure exerted on the collar distorts the O-ring thereby forming a seal against the conduit.

U.S. Pat. No. 3,884,809, issued May 20, 1975, to Duane D. Logsdon, describes a scupper drain structure. The scupper includes a grate which is mounted with threaded fasteners to an apparently pre-formed, lamellar acrylic member. The acrylic member has an upper and a lower portion. The lower portion of the acrylic member appears to frictionally interengage with a drain pipe. The scupper is secured to the roof by nails. Roofing materials lap the flange of the grate.

U.S. Pat. No. 3,909,412, issued Sep. 30, 1975, to Francis J. Patry, describes a roof drain arrangement. The device includes a grated strainer which mounts to a gravel stop with metal hooks soldered to the gravel stop. The gravel stop rests on top of roofing membrane. The gravel stop has an aperture in which a tubular sleeve is received. The sleeve includes a flange that abuts the top surface of the gravel stop. An intermediate portion of the device has an upper segment and a lower segment. The upper segment has gripping fingers which frictionally engage the sleeve. The upper segment also abuts the interior annular flange of an encircling tubular member fixed to the roof substrate. Compressive force between the tubular sleeve and the roof substrate is effectuated by advancing the gripping fingers of the intermediate portion along the tubular sleeve and against the tubular member. The lower segment is fixed to the drain pipe by a conventional draw band.

U.S. Pat. No. 4,243,251, issued Jan. 6, 1981, to William W. Lindquist, describes a floor or roof drain fitting. The device includes a tubular member having an upper and a lower portion. The upper portion of the tubular member has an outward annular flange that abuts surface material. The lower portion of the tubular member has exterior threads. The device includes a generally funnel-shaped sleeve having an upper and a lower portion. The sleeve receives the tubular member. The upper portion of the sleeve abuts the under side of the roof structure. The lower portion abuts a retaining nut. The retaining nut interengages with the threads of the tubular member.

U.S. Pat. No. 4,487,690, issued Dec. 11, 1984, to Duane D. Logsdon, describes a sump or flush installable roof drain. The device includes a frusto-conically-shaped grate that mounts with threaded fasteners to an insert member. The insert member has a centrally located aperture. The insert member is secured with threaded fasteners to a generally funnel-shaped tubular central section having an upper and a lower portion. The upper portion has a flange which abuts the roofing membrane and is nailed to the roof sub-structure. The insert member and roof membrane are sealed with hot tar.

U.S. Pat. No. 4,505,499, issued Mar. 19, 1985, to Malcom S. Uglow, describes a roof drain insert coupling. The device includes a tubular drain insert having an upper and a lower portion. The upper portion has an outwardly annular flange that abuts roof insulation material. A sealing layer seals the flange and insulative material junction. A course grate is received in the aperture in the upper portion of the tubular insert. The device also includes a generally funnel-shaped drain pipe having an upper and a lower portion. The upper portion has an outward annular flange secured between the insulative layer and the roof substrate. A sealing layer seals the flange and roof substrate junction. The drain pipe receives the tubular drain insert and is fixed relative thereto by a coupling device. The coupling device is received in and maintains close tolerances with the drain pipe. The coupling device includes two tubular members each having an outward annular flange. Each annular flange has radially diverged throughbores in registration with the throughbores of the other. Threaded fasteners are received in each registered throughbore and fix relative distance between the tubular members. A sleeve of pliable material receives the tubular members and is secured therebetween. Reducing the relative distance between the tubular members by tightening the threaded fasteners distorts the sleeve against the drain pipe fixing the coupling device relative thereto.

U.S. Pat. No. 4,505,814, issued Mar. 19, 1985, to Marshall W. Marshall, describes an adjustably extensible roof drain receptacle. The device includes a frusto-conically-shaped strainer dome frictionally interengaged with a flashing ring having a central aperture. The flashing ring sealingly abuts a top coating layer. The flashing ring is retained in an aperture through the roof substrate by threaded fasteners threadingly interengaged with a drain body having a central aperture. The drain body has an upper and a lower portion. The upper portion has an outward annular flange that abuts the roof substrate. The lower portion receives a drain pipe. An elastomeric seal is sealingly interposed between the drain body and the drain pipe. The flange of the drain body also abuts an adjustable, tubular collar. The collar has an inward annular flange having throughbores. The collar rests on an annular flange of a housing. The housing further includes an outward annular flange that abuts and is fixed with threaded fasteners to the upper side of the roofing substrate. An underdeck clamp having radially diverged throughbores and an upstanding radial flange abuts the underside of the roofing substrate. Threaded fasteners connect and maintain the underdeck clamp relative to the housing.

None of the above references, taken alone or in combination, are seen as teaching or suggesting the presently claimed roof drain.

SUMMARY OF THE INVENTION

The present invention relates to roof drains. The invention includes a grated, dome-shaped, inverted, frusto-conically-shaped cover. The cover screens debris from entry into the drain pipe. The cover includes an outward annular flange having radially diverged throughbores. The cover mates with a roofing material clamp. The roofing material clamp has a central aperture and radially diverged throughbores, some in registration with the throughbores in the cover, others offset. The roofing material clamp further includes a notched, radial flange disposed outboard of the periphery of the cover. The flange discourages blockage of the cover by gravel and other debris.

The present invention also includes a generally funnel-shaped tubular drain body having an upper and a lower portion. The upper portion includes an outward annular flange having radially diverged threaded bores. Some of the threaded bores are in registration with the throughbores in the cover and roofing material clamp. The balance of the threaded bores are in registration with the offset throughbores in the material clamp. Threaded fasteners secure the material clamp alone to the drain body by means of the offset throughbores and threaded bores. Threaded fasteners also secure the cover and roofing material clamp to the drain body by means of the non-offset throughbores and threaded bores. Roofing material is sealingly and clampingly maintained between the roofing material clamp and the drain body. The lower portion of the drain body has exterior threads. A nut threadingly interengages with the threads.

The drain body is inserted into an aperture in the roof substrate. The annular flange abuts the roofing substrate. The drain body may, but does not necessarily frictionally engage the roof substrate.

The invention further includes a generally funnel-shaped sleeve that complementarily encases the drain body. The sleeve has an upper and a lower portion. The upper portion includes an annular flange. The flange abuts the underside of the roofing substrate. The sleeve is maintained against the substrate by the nut that threadingly interengages with the drain body threads. Tightening the nut increases clamping force the drain body and sleeve exert against the roofing substrate. Increased clamping force decreases the potential for roof material bulges and depressions.

In consideration of the above, an object of the invention is to provide a roof drain which screens debris.

Another object of the invention is to provide a roof drain that sealingly clamps roofing material.

A further object Of the invention is to provide a roof drain that clampingly secures the drain to the roof substrate and discourages roof material bulges and depressions.

Yet another object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENT

Figure 1:
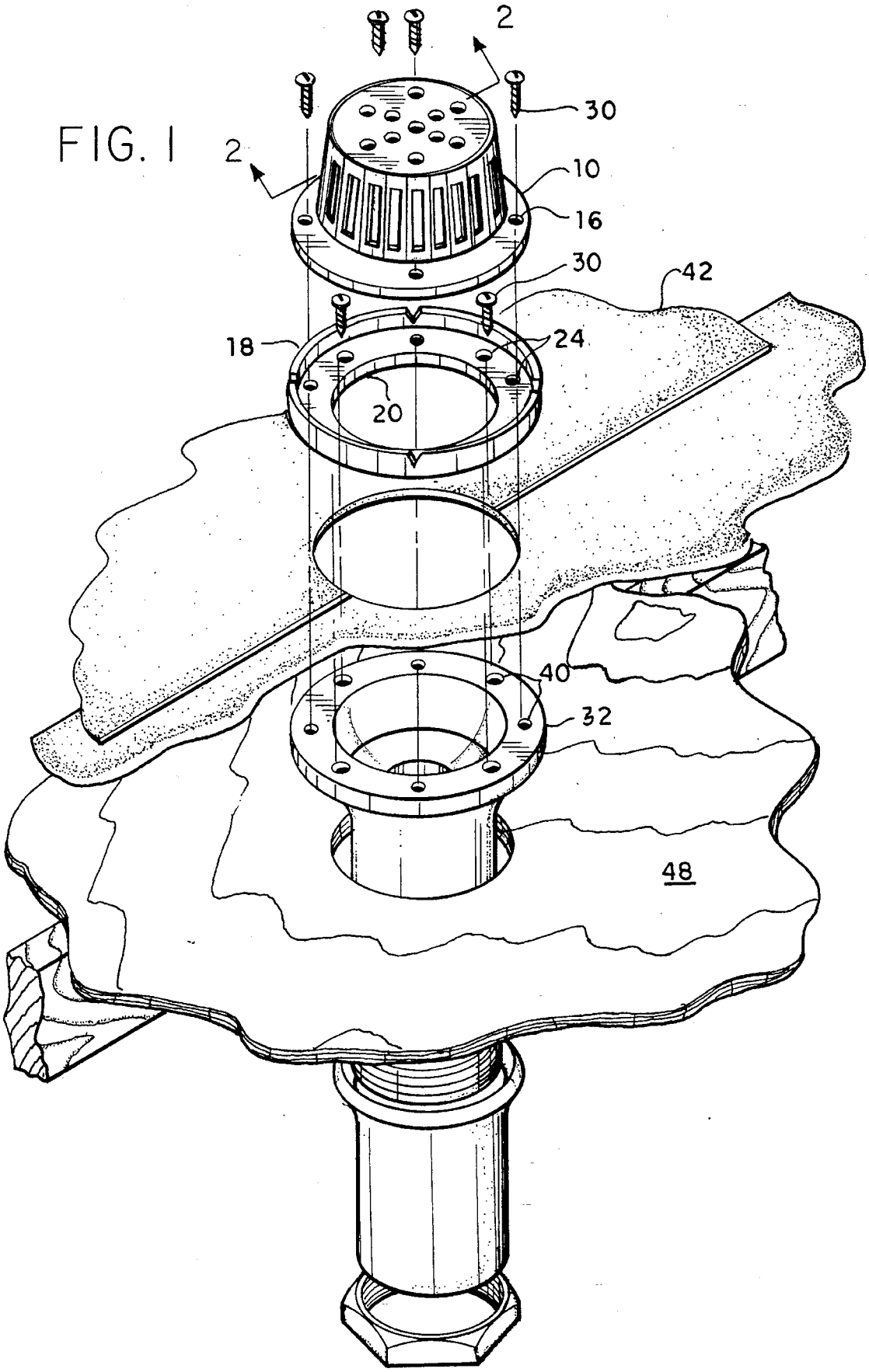
FIG. 1 is an exploded environmental perspective of the invention installed in a roof.
Figure 2:
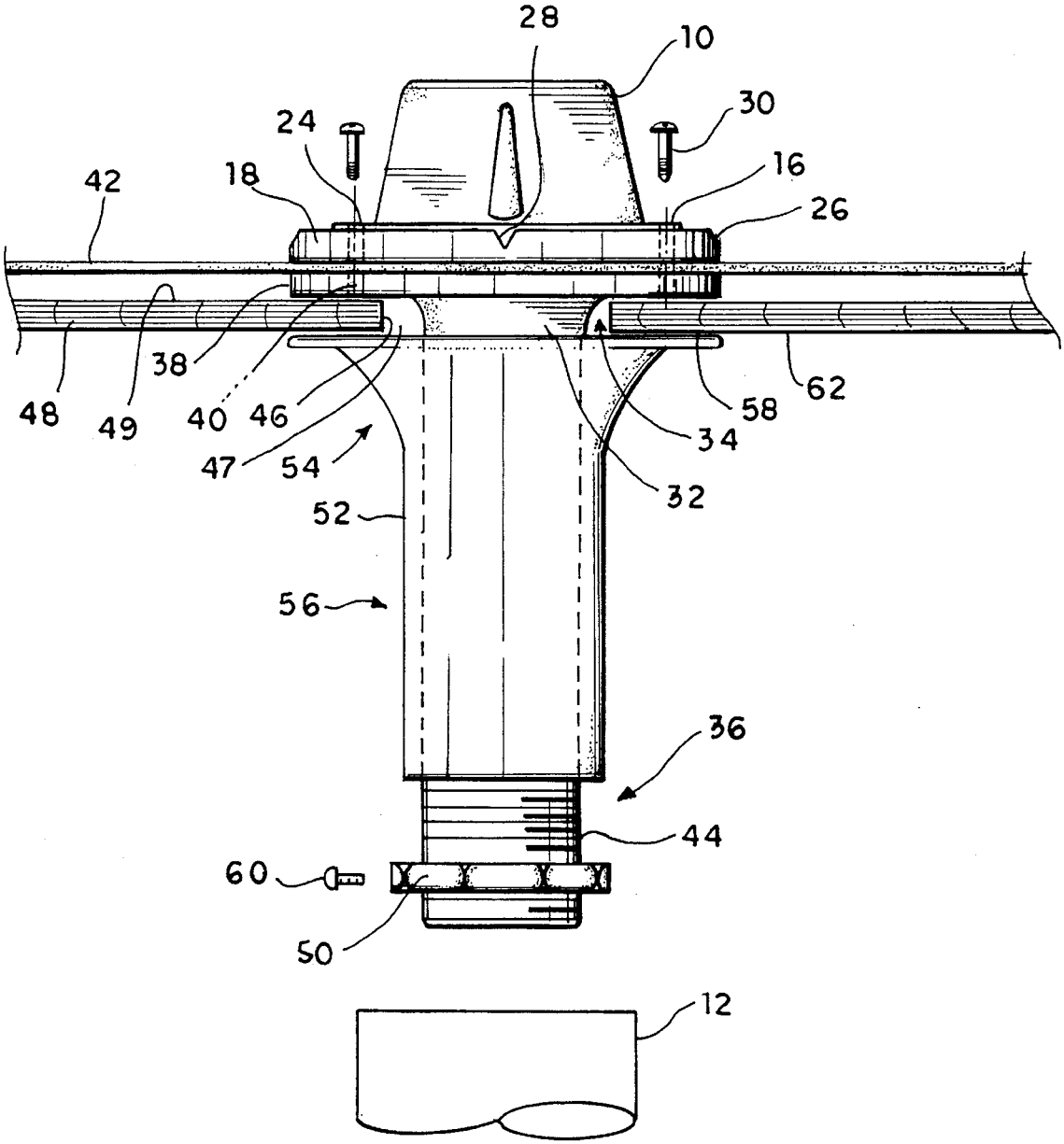
FIG. 2 is a cross-sectional detail view of the invention shown at line 2—2 in FIG. 1.

Referring to FIGS. 1 and 2, the invention includes a grated, inverted, frusto-conical cover 10. The cover 10 screens debris from entry into the drain pipe 12. The cover 10 includes an annular flange 14 having radially diverged throughbores 16.

The invention also includes a roofing material clamp 18. The roofing material clamp 18 has a central aperture 20 and radially diverged throughbores 24. The throughbores 24 are in registration with the throughbores 16 in the cover 10. An upstanding radial flange 26 having notches 28 is disposed outboard of the periphery of the cover 10. The radial flange 26 discourages blockage of the cover by gravel and debris while permitting fluid flow.

The invention further includes a generally funnel-shaped tubular drain body 32 having an upper portion 34 and a lower portion 36. The upper portion 34 includes an outward annular flange 38 having radially diverged threaded bores 40. The threaded bores 40 are in registration with the throughbores 16 and 24 of the cover 10 and roofing material clamp 18, respectively. The roofing material clamp 18 may be secured to the drain body 32 independently of the cover 10.

As best shown in FIG. 1, a set of threaded fasteners 30 may be used to secure the roofing material clamp 18 alone to the drain body 32 and the remaining set of threaded fasteners 30 may be used to secure the cover 10 and roofing material clamp 18 to the drain body 32. Roofing material 42 is sealingly and clampingly maintained between the roofing material clamp 18 and the drain body 32.

The upper portion 34 of the drain body 32 abuts or loosely fits within the annular surface 46 of the drain aperture 47 in the roof substrate 48. The annular flange 38 abuts top surface 49 of the roof substrate 48. The lower portion 36 of the drain body 32 has exterior threads 44. A nut 50 threadingly interengages with the threads 44. The nut 50 includes a set screw 60 for restricting rotation of the nut 50 relative to the drain body 32.

The invention additionally includes a sleeve 52 that complementarily encases the drain body 32. The sleeve 52 has an upper portion 54 and a lower portion 56. The upper portion 54 includes an annular flange 58. The flange 58 abuts the underside of the roofing substrate 48. The sleeve 52 is maintained against the roof substrate 48 by the nut 50. Tightening the nut 50 urges sleeve 52 against the drain body 32 to exert an increased clamping force on the roofing substrate 48. Increased clamping force discourages formation of bulges and depressions in the roof material 42.

The present invention is not intended to be limited to the sole embodiment described above, but to encompass any and all embodiments within the scope of the following claims.

I claim:

1. A roof drain apparatus comprising:

a grated,dome-shaped cover, said cover including an outward annular flange having throughbores;

a roofing material clamp having an upstanding radial flange, an upper surface, a lower surface and a central aperture, said roofing material clamp including throughbores in registration with the throughbores of said cover;

a generally funnel-shaped tubular drain body having an upper portion and a lower portion, said upper portion having an outward annular flange with threaded bores in registration with the throughbores of said roofing clamp, said lower portion having exterior threads;

threaded fasteners for demountably fixing said cover and said roofing material clamp to said drain body;

a generally funnel-shaped tubular sleeve for receiving said drain body, said sleeve having an upper portion and a lower portion, said upper portion having an outward annular flange; and a nut interengaging said threads of said drain body, said nut abutting said lower portion of said drain body; whereby upon installation of the roof drain apparatus and tightening said nut, said sleeve is urged against said drain body to exert a clamping force on a roof substrate therebetween, and thereby prevent the formation of bulges and depression in the roof substrate.

2. A roof drain apparatus as recited in claim 1, wherein said upstanding radial flange has at least one notch.

3. A roof drain apparatus as recited in claim 1, wherein said nut includes a set screw to prevent rotation of the nut relative to said drain body.

* * * * *